United States Patent [19]

Miller et al.

[11] Patent Number: 4,522,127

[45] Date of Patent: Jun. 11, 1985

[54] RAILWAY TIE PLUG DRIVING APPARATUS

[75] Inventors: John R. Miller; John L. Stubbs, both of Charlotte, N.C.

[73] Assignee: Southern Railway Company, Washington, D.C.

[21] Appl. No.: 472,487

[22] Filed: Mar. 7, 1983

[51] Int. Cl.[3] ..... E01B 31/26

[52] U.S. Cl. ..... 104/17 R; 104/1 R; 227/156

[58] Field of Search ..... 104/1 R, 2, 7 R, 7 B, 104/12, 16, 17 R; 227/7, 110, 111, 156; 83/369; 238/370

[56] References Cited

U.S. PATENT DOCUMENTS

| | | | |
|---|---|---|---|
| 2,915,754 | 12/1959 | Wandel | 227/7 X |
| 2,926,617 | 3/1960 | Kershaw | 104/7 R X |
| 3,114,331 | 12/1963 | Elliott | 104/17 R |
| 3,144,835 | 8/1964 | Pehoski et al. | 104/17 R |
| 3,645,209 | 2/1972 | Von Beckmann | 104/1 R X |
| 3,753,404 | 8/1973 | Bryan, Jr. | 104/17 R |
| 3,762,333 | 10/1973 | Theurer et al. | 104/17 R X |
| 3,899,265 | 8/1975 | Lang | 83/369 X |
| 3,949,678 | 4/1976 | Theurer | 104/12 |
| 3,984,040 | 10/1976 | Fry | 227/7 |
| 4,265,387 | 5/1981 | Strouse | 227/7 |

*Primary Examiner*—Randolph Reese

*Attorney, Agent, or Firm*—Watson, Cole, Grindle & Watson

[57] ABSTRACT

An apparatus for driving plugs into railway tie holes remaining after the removal of at least one rail and its associated tie plate and rail spikes from the railway ties, includes a vehicle adapted for travel along narrow gauge rails temporarily installed on the ties, or along the standard gauge rails while spanning a rail removed section of the track. Vertically reciprocable tamper plates are mounted on the vehicle frame and are reciprocated by the provision of limit switches on the frame in timed relationship to the rate of travel of the vehicle along the rails.

4 Claims, 6 Drawing Figures

RAILWAY TIE PLUG DRIVING APPARATUS

BACKGROUND OF THE INVENTION

This invention relates generally to an apparatus for the driving of plugs into railway tie holes remaining after the removal of one or both rails together with their tie plates and spikes from the railway ties, and more particularly to such an apparatus which automatically drives plugs into the railway tie spike holes in timed relationship with the speed of the apparatus moving along temporarily installed narrow gauge rails.

When reconditioning a railway track, it is customary to remove each rail, together with its supporting tie plates and spikes, one-at-a-time while leaving the remaining rail in place as a support for work vehicles used to perform intended work operations along the track. The spike holes remaining in the ties after such removal must then be plugged to facilitate the re-laying of a new rail or portions of the old rail as the rail spikes are driven into the plugged holes. Plugging had been carried out manually by first inserting wooden pegs, or the like, into the spike holes and thereafter manually driving them in place using hand tamping rods or hammers. After re-laying the rail, the other rail, together with its tie plates and rail spikes were then taken up and the manual spike hole plugging operation was repeated.

To avoid this time consuming and laborious operation, railway tie hole-plugging machines were developed for carrying out the plug driving operation. As set forth in U.S. Pat. Nos. 3,114,331 and 3,144,835, such machines require the use of an existing rail for movement therealong during the hole-plugging operation which is carried out by the provision of a vertically extending rod driven by a piston. The U.S. Pat. No. 3,114,331 machine has a support pad for supporting the free end of the machine in the vicinity of the spike holes, so that the machine must be manually lifted at its free end and moved along the rail during the plugging operation. The U.S. Pat. No. 3,144,835 machine differs mainly in the provision of a pair of wheel assemblies adapted to engage the adzed surfaces of the ties to facilitate movement of the machine along the rail. And, in both of these prior art machines, an operator is required to control operation of the reciprocating driving member.

Although these prior art machines improve upon the manual approach in driving plugs into the spike holes, they have been found cumbersome to operate, costly to fabricate and largely inefficient as they operate slowly and require the full attendance of an operator to drive the plugs individually as the machine is moved first along one support rail and then along the other support rail.

SUMMARY OF THE INVENTION

It is therefore an object of the present invention to provide an apparatus for driving plugs into the spike holes remaining after the removal of one or both rails, tie plates and rail spikes, in an improved and highly efficient manner as a plug tamper reciprocates automatically in timed relationship to the speed of travel of the apparatus along narrow gauge rails temporarily installed along the ties.

Another object of this invention is to provide such an apparatus which includes a vehicle movable along the narrow gauge rails for carrying out the plug driving operation without the attendance of an operator, the tamper plate reciprocating vertically under the action of a pneumatic piston and cylinder unit actuated by limit switches located on the vehicle frame. A first of such switches is tripped during rolling movement of the driving apparatus wheels for lowering the tamper plate, and the other of such switches is tripped at the end of the downward tamper plate movement for elevating the tamper plate in readiness for a following downward reciprocation as the first switch is again tripped. Vertical reciprocation continues as the pneumatic piston and cylinder unit is actuated by the successive opening and closing of the limit switches.

A further object of this invention is to provide such an apparatus wherein radially extending and equally spaced cams at the circumference of one of the vehicle wheels repeatedly actuate the first switch at predetermined regular intervals for extending the piston of the piston and cylinder unit thereby lowering the tamper plate for driving the plugs upon impact, the other of such switches being actuated by one of the pair of parallel link arms interconnecting the tamper plate with the vehicle frame to effect piston retraction each time at the lower end of tamper plate travel.

A still further object of the present invention is to provide such an apparatus wherein a pair of such tamper plates may be provided for simultaneous plug driving operation after the removal of both rails and tie plates from the railway ties, each tamper plate being reciprocated by a pneumatic piston and cylinder unit actuated simultaneously by the cam/first limit switch arrangement.

A still further object of this invention is to provide such an apparatus wherein a split bracket having pivotally interconnected parts is provided for supporting the or each piston or cylinder unit, the parts of the bracket being normally pressed together and capable of pivotally moving apart by cushioning springs for cushioning the impact of the tamper plate when it occassionally makes other than a direct impact against a railroad tie.

Other objects, advantages and novel features of the invention will become more apparent from the following detailed description of the invention when taken in conjunction with the accompanying drawings.

DETAILED DESCRIPTION OF THE INVENTION

Figure 1:
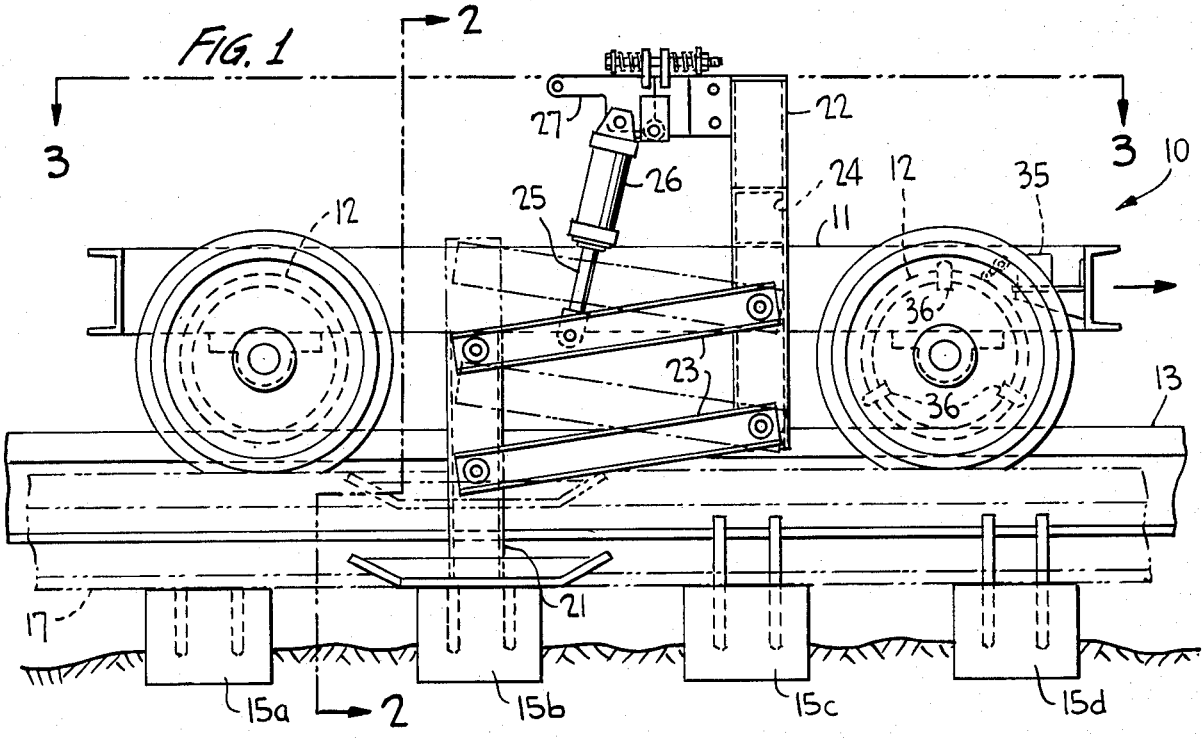
FIG. 1 is a side elevational view of the plug driving apparatus according to the invention shown supported for movement along narrow gauge wheels.

Turning now to the drawings wherein like reference characters refer to like and corresponding parts throughout the several views, the plug driving apparatus according to the invention is generally designated 10 and comprises a vehicle having a frame 11 on which two sets of narrow gauge wheels 12 are mounted to facilitate travel of the vehicle along narrow gauge rails 13 temporarily installed on a metal frame or cradle 14 mounted along railroad ties 15. The narrow gauge rails are installed in a customary manner known in the art and, as such, forms no part of the invention. The present apparatus likewise includes sets of standard rail wheels 16 for movement of the apparatus along standard gauge rails to the work site. One of these standard rails 17 is shown in phantom outline in FIG. 1 since it will have been removed from the ties, together with its support tie plates and rail spikes thereby exposing the spike holes, when apparatus 10 is located at the work site.

Each tamper assembly according to the invention comprises a tamper plate 18 disposed at each side of the vehicle frame (FIG. 2) for vertical reciprocating movement directly above spike holes 19 which remain after the removal of both rails and their tie plates. Each tamper plate is mounted in the same manner on the vehicle frame for vertical reciprocating movement, so that details pertaining to only one of the tamper plates will be described. And, the invention may include only a single tamper plate for driving tie plugs after removal of only one of the rails and tie plates.

Tamper plate 18 is centered on and is fixedly secured as by welding to the lower free end of an upstanding hollow and rectangular support post 21 and is reciprocated together therewith along its central axis. Another hollow and rectangular support post 22 is secured to one of the side members of the vehicle frame and extends vertically downwardly between the forward and aft narrow gauge wheels 12. Pairs of spaced, parallel link arms 23 are pivotally connected at opposite ends to support posts 21 and 22 for maintaining a vertically upright position of post 21 during its reciprocation. And, a support cross bar 24 extends between support posts 22.

Figure 4:
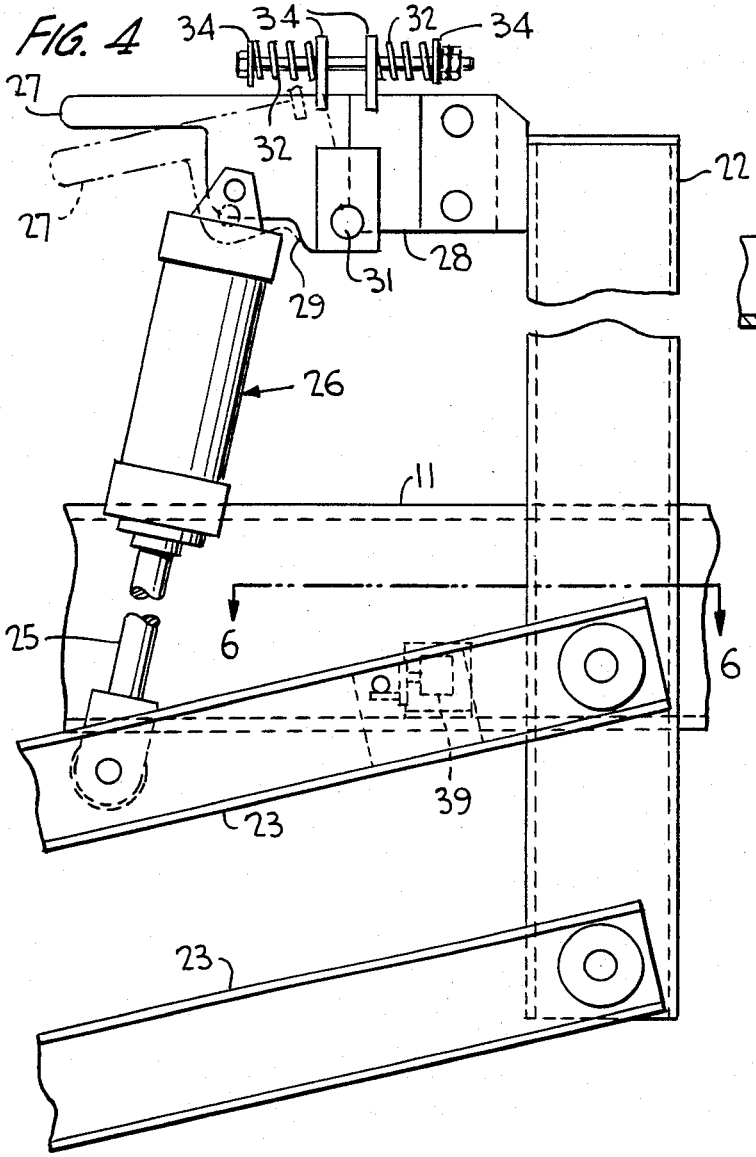
FIG. 4 is a side elevational view, at a slightly enlarged scale, of a portion of a tamper plate assembly.

Piston 25 of a pneumatic piston and cylinder unit 26, connected to a pressurized air source (not shown), is pivotally interconnected at its outer end with the upper pair of link arms 23, and the cylinder end of the unit is pivotally interconnected with a split bracket 27 mounted on support post 22. This bracket, as shown more clearly in FIG. 4, comprises segments 28 and 29 pivotally interconnected as at 31 for movement away from one another as shown in phantom outline, with the segments maintained in contact with one another by means of coil springs 32 located on a rod 33 and compressed between collars 34. The function of this split bracket will be described in detail hereinafter.

Figure 5:
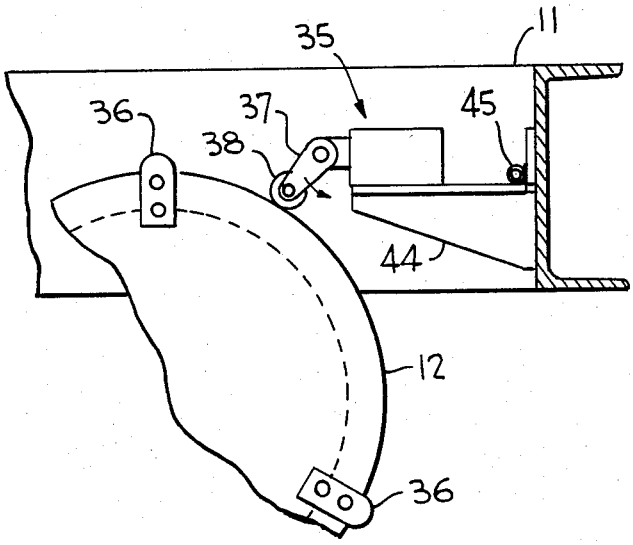
FIG. 5 is a side elevational view at a slightly enlarged scale of the first limit switch arrangement.

A first limit switch 35, more clearly shown in FIG. 5, is operatively interconnected with each of the units 26, provided for tamper plates 18, for effecting simultaneous retraction of both pistons 25 thereof when the limit switch is actuated. A plurality (three shown in FIG. 1) of radially extending and circumferentially spaced cams 36, more clearly shown in FIG. 5, are mounted equally spaced apart on one of the narrow gauge wheels 12 disposed adjacent this first switch. A crank arm 37 is mounted for movement in the direction of its arrow in FIG. 5 for actuating limit switch 35 when an idler roller 38 on the crank arm, lying in the path of rotation of the cams about the rotational axis of the wheel, is impacted by each cam.

Figure 2:
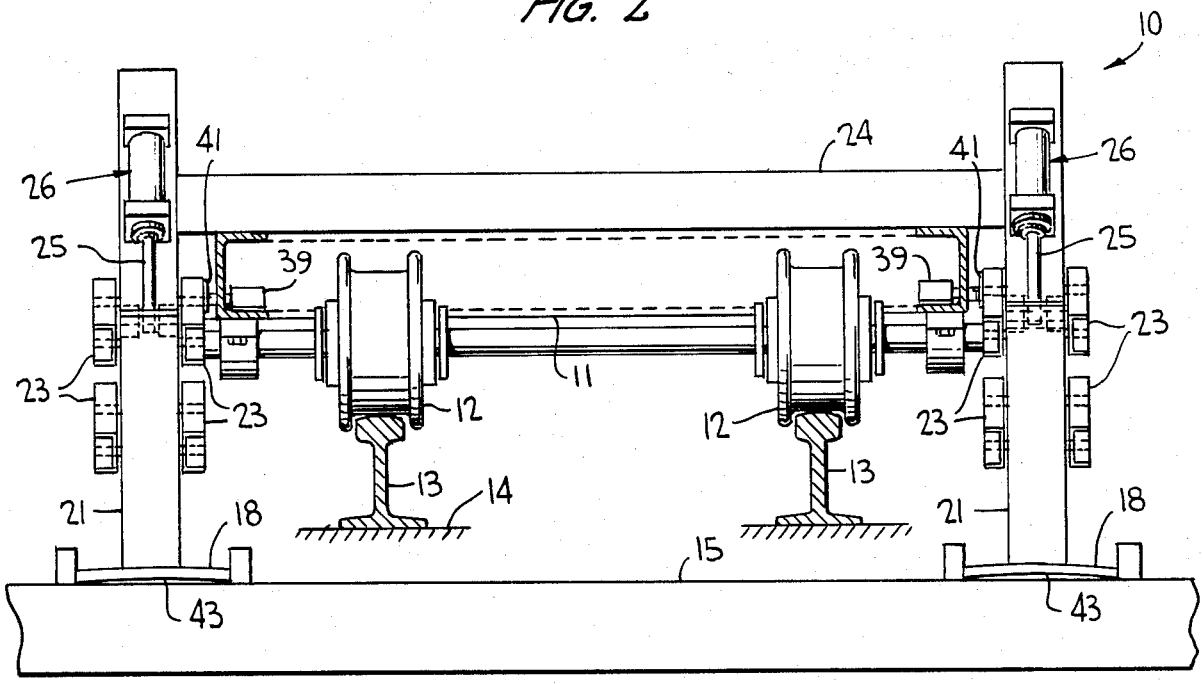
FIG. 2 is an elevational view of the tamper plate assemblies of the apparatus taken substantially along the line 2—2 of FIG. 1.
Figure 3:
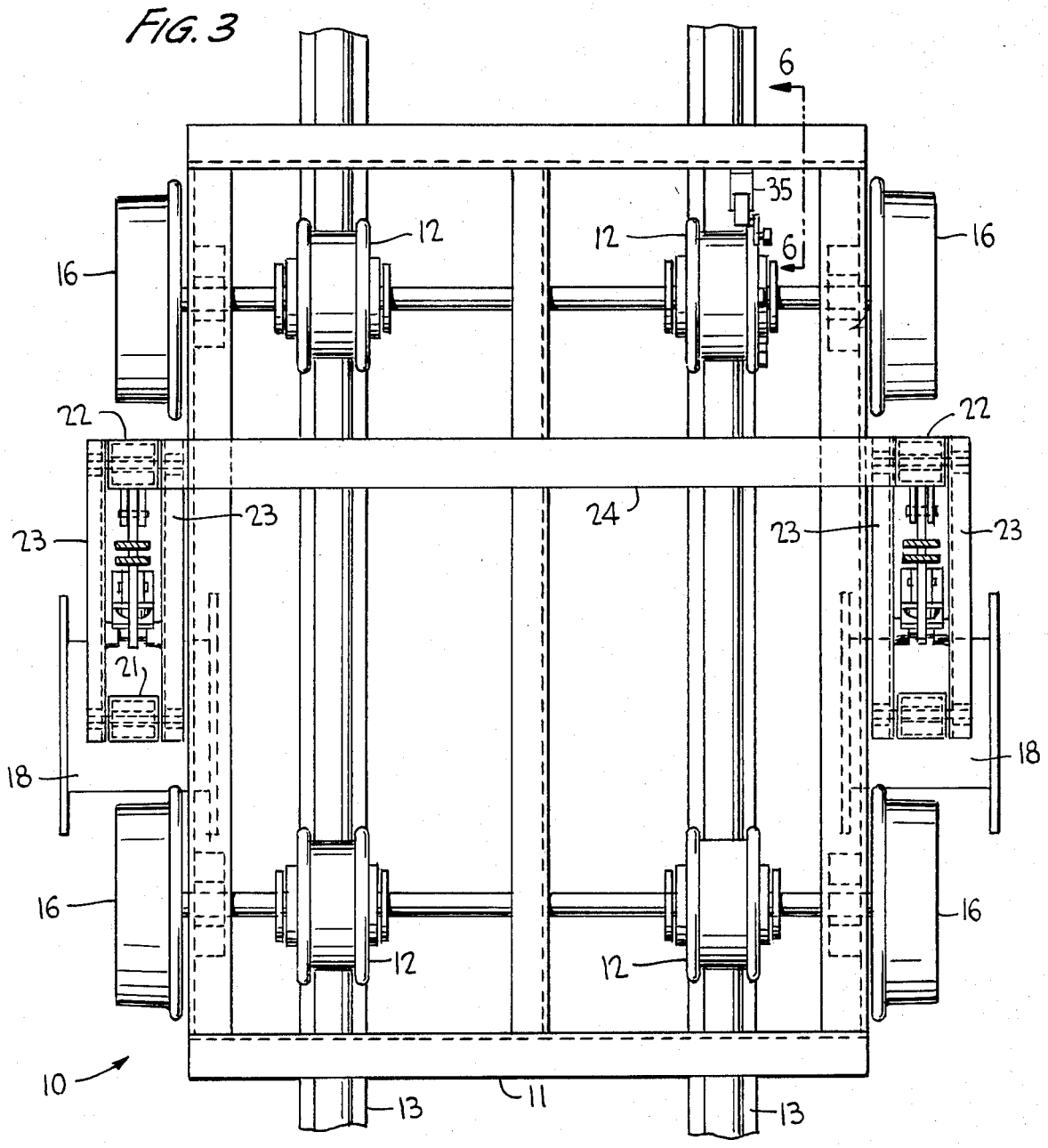
FIG. 3 is a top plan view of the apparatus taken substantially, along the line 3—3 of FIG. 1.
Figure 6:
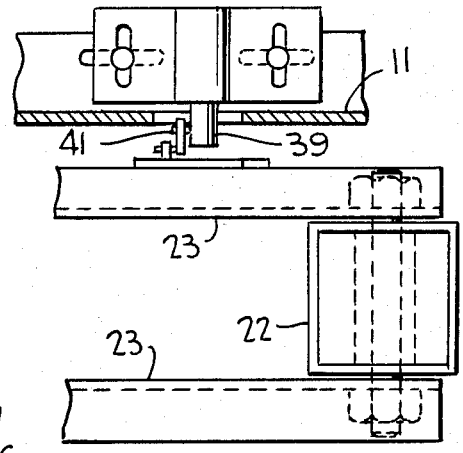
FIG. 6 is a detail view of the second limit switch arrangement taken substantially along the line 6—6 of FIG. 4.

A second limit switch 39, shown in detail in FIG. 6, is mounted on vehicle frame 11 and is associated with each tamper assembly as shown in FIG. 2. These switches are operatively connected respectively with piston and cylinder units 26 and are each actuated by a trip 41 mounted on an inner one of the upper pair of link arms 23. The disposition of this second limit switch and its trip are such that contact therebetween is made at the end of the downstroke of tamper plate 18.

In operation, the aforedescribed apparatus is moved along the narrow gauge rails in the direction of the arrow of FIG. 1, by a work vehicle, engine, or the like, for automatically driving the plugs into the spike holes remaining after the rails, tie plates and rail spikes are removed. Plugs 42, usually wooden, are first manually inserted partially into spike holes 19. Movement of the plug driving apparatus along the narrow gauge rails effects vertical reciprocation of each tamper plate between the phantom and solid outline positions thereof shown in FIG. 1. Each time one of the cams 36 impacts against idler roller 38 of first limit switch 35, crank arm 37 is moved in the direction of its arrow and effects an extension of both piston rods 25 as pressurized air is ported behind the piston head to thereby drive the tamper plate downwardly. At the end of the downstroke position of each tamper plate shown in solid outline in FIG. 1, second limit switch 39 is actuated by trip 41 which effectively causes the pressurized air in unit 27 to be vented to thereby retract piston 25 so as to move each tamper plate into its phantom outline position shown in FIG. 1. And, as the narrow gauge wheels continue to rotate about their rotational axes, another cam 36 impacts against idler roller 38 to again effect extension of piston rods 24 and a lowering of the tamper plates after which they are subsequently elevated upon contact between switch 39 and trip 41. This vertical reciprocation of the tamper plates continues, upon actuation of the limit switches, as the apparatus moves along the narrow gauge rails and is timed to the rate of travel therealong. During reciprocation, direct and indirect impacts are made between the tamper plates and the railway ties as the plugs 42 are driven into spike holes 19 from their position shown in ties 15*c* and 15*d* in FIG. 1 to their position shown in ties 15*a* and 15*b* in FIG. 1. Thus, the tamper plate may only indirectly impact an underlying tie, or may indirectly impact a pair of adjacent underlying ties during vertical reciprocation in which case the vertical axis of support post 21 lies somewhere between adjacent ties. In order to cushion this effect to avoid damage to the tamper plate, springs 32 permit segments 29 of the split bracket to move into its phantom outline position of FIG. 4. And, it should be pointed out that the outer surface of each tamper plate may be covered with a rubber padding to avoid any sidewise movement of the plugs while being impacted. And, the outer surface of each tamper plate is slightly concave as at 43 in FIG. 2 to accommodate the slight tilt of the plugs when driven into the correspondingly tilted spike holes.

Furthermore, it can be seen that first limit switch 35 is mounted on a support bracket 44 which is pivotally mounted as at 45 to frame 11 of the vehicle. Thus, this limit switch may be moved upwardly away from adjacent wheel 12, to thereby avoid contact with cams 36, when the apparatus is being transported on standard rails 17 to and from the work site.

From the foregoing, it can be seen that a simple and efficient yet highly effective plug driving apparatus has been designed for automatically driving railway tie plugs into open spike holes without the need for any manual operation of the driving mechanism and with little risk to damaging the pegs while being driven.

Obviously, many modifications and variations of the present invention are made possible in the light of the above teachings. For example, the narrow gauge track could be eliminated, and the present apparatus could be designed for movement along the rails of a standard gauge track. The frame of the apparatus would be elongated for spanning a section of the track at which the rail or rails are removed sufficiently to expose the spike holes. The structure, function and operation of such an alternate design is the same as the aforedescribed except that the forward wheels move along the standard gauge rails of the old track, and the rear wheels move along the standard gauge wheels of the new track. It is therefore to be understood that within the scope of the appended claims the invention may be practiced otherwise than as specifically described.

What is claimed is:

1. An apparatus for driving plugs into railway tie holes remaining after the removal of at least one rail and the associated tie plates and rail spikes thereof from railway ties of at least a section of a railway track, comprising a vehicle having a frame and wheels adapted for travel along the track, at least one vertically reciprocable tamper plate on one side of said frame for driving the plugs upon impact therewith, means for pivotally interconnecting said tamper plate with said frame, a pivotally mounted pneumatically operable piston and cylinder unit supporting said tamper plate from said vehicle frame for vertically reciprocating said tamper plate as the piston of said unit is extended and retracted, a split bracket having pivotally connected segments for supporting said unit from said frame, spring means acting between said segments for cushioning said tamper plate when making direct impacts against the railway ties, first limit switch means on said frame for extending said piston and lowering said tamper plate to drive the plugs, first means on said vehicle for actuating said first limit switch means at predetermined regular intervals, said first actuating means being mounted on one of said vehicle wheels for rotation together therewith about the wheel axis, second limit switch means on said vehicle frame for retracting said piston and elevating said tamper plate, and second means on said interconnecting means for actuating said second limit switch means at the end of each extension stroke of said piston, whereby said tamper plate is vertically reciprocated at said regular intervals for driving the plugs during movement of said vehicle along said rails.

2. The apparatus according to claim 1, wherein said tamper plate is mounted at a lower end of an upstanding support post for reciprocation together therewith along its central axis, said interconnecting means comprising a pair of spaced parallel link arms extending between said support post and said vehicle frame, and said unit being pivotally mounted on one of said link arms.

3. The apparatus according to claim 1, wherein said first actuating means comprise a plurality of equally and circumferentially spaced radially extending cam elements, and said first switch means comprises a pivotable roller extending into the rotational path of travel of said cam elements for impacting thereagainst.

4. The apparatus according to claim 1, wherein another vertically reciprocable spaced tamper plate is provided on an opposite side of said frame for driving the plugs upon impact therewith, the plugs being driven into railway tie holes remaining after the removal of both rails and their associated tie plates and rail spikes from the railway ties, means for pivotally interconnecting said another tamper plate with said frame, another pivotally mounted pneumatically operable piston and cylinder unit supporting said another tamper plate from said frame for vertically reciprocating said another tamper plate as the piston of said unit is extended and retracted, another split bracket having pivotally connected segments for supporting said another unit from said frame, spring means acting between said segments of said another bracket for cushioning said tamper plate said first switch means being provided for simultaneously extending said piston of said units and lowering said tamper plates to drive the plugs, whereby said tamper plates are vertically reciprocated simultaneously at said regular intervals.

* * * * *